US012366196B2

(12) United States Patent
Buvarp et al.

(10) Patent No.: US 12,366,196 B2
(45) Date of Patent: Jul. 22, 2025

(54) COMPONENT HOUSING UNIT AND A VEHICLE THERMAL MANAGEMENT SYSTEM COMPRISING A COMPONENT HOUSING UNIT

(71) Applicants: Ningbo Geely Automobile Research & Development Co., Ltd., Ningbo (CN); Zhejiang Geely Holding Group Co., Ltd., Zhejiang (CN)

(72) Inventors: Daniel Buvarp, Gothenburg (SE); Mikael Jönsson, Onsala (SE)

(73) Assignees: Ningbo Geely Automobile Research & Dev. Co., Ltd., Ningbo (CN); Zhejiang Geely Holding Group Co., Ltd., Zhejiang (CN)

( * ) Notice: Subject to any disclaimer, the term of this patent is extended or adjusted under 35 U.S.C. 154(b) by 371 days.

(21) Appl. No.: 17/994,178

(22) Filed: Nov. 25, 2022

(65) Prior Publication Data

US 2023/0082483 A1 Mar. 16, 2023

Related U.S. Application Data

(63) Continuation of application No. PCT/CN2021/100322, filed on Jun. 16, 2021.

(30) Foreign Application Priority Data

Jul. 7, 2020 (EP) ..... 20184550

(51) Int. Cl.
*F01P 11/02* (2006.01)
*F01P 3/20* (2006.01)
(Continued)

(52) U.S. Cl.
CPC ..... *F01P 11/029* (2013.01); *F01P 3/20* (2013.01); *F01P 5/10* (2013.01); *F01P 7/165* (2013.01); *F01P 2005/105* (2013.01)

(58) Field of Classification Search
CPC .... F01P 11/029; F01P 3/20; F01P 5/10; F01P 7/165
(Continued)

(56) References Cited

U.S. PATENT DOCUMENTS

2004/0108006 A1* 6/2004 McLane ..... F01P 7/167 137/625.47
2011/0284107 A1 11/2011 Ciak
(Continued)

FOREIGN PATENT DOCUMENTS

| | | | | |
|---|---|---|---|---|
| CN | 105019996 A | | 11/2015 | |
| CN | 110481275 A | | 11/2019 | |
| CN | 110962532 A | | 4/2020 | |
| CN | 112277559 A | * | 1/2021 | ..... B60H 1/00007 |
| DE | 102010063264 A1 | | 6/2012 | |
| DE | 102017011428 A1 | | 6/2018 | |
| EP | 0969189 A1 | | 1/2000 | |
| EP | 1201889 A1 | | 5/2002 | |

(Continued)

OTHER PUBLICATIONS

International Search Report from International Application No. PCT/CN2021/100322, mailed Sep. 15, 2021, 2 pages.

*Primary Examiner* — Orlando E Aviles
*Assistant Examiner* — Niki M Eloshway
(74) *Attorney, Agent, or Firm* — Tucker Ellis LLP

(57) ABSTRACT

A component housing unit for a vehicle thermal management system is configured for attachment to an exterior surface of an expansion tank having an interior surface defining an interior volume. The component housing unit is configured for connection to a first thermal control loop and a second thermal control loop. The component housing unit is configured for connecting the interior volume of the expansion tank to the first thermal control loop and the second thermal control loop respectively. The component housing unit includes a first component interface configured for direct attachment of a first system component connected to the first thermal control loop, and a second component
(Continued)

interface configured for direct attachment of a second system component connected to the second thermal control loop.

13 Claims, 6 Drawing Sheets

(51) Int. Cl.
*F01P 5/10* (2006.01)
*F01P 7/16* (2006.01)

(58) Field of Classification Search
USPC ..... 220/564
See application file for complete search history.

(56) References Cited

U.S. PATENT DOCUMENTS

| | | | |
|---|---|---|---|
| 2012/0168118 | A1 | 7/2012 | Myers |
| 2017/0373359 | A1 | 12/2017 | Krull |

FOREIGN PATENT DOCUMENTS

| | | | | | |
|---|---|---|---|---|---|
| EP | 3594467 | A1 | | 1/2020 | |
| GB | 2337235 | A | | 11/1999 | |
| GB | 2581474 | A | * | 8/2020 | ..... F01P 5/10 |
| JP | H10266856 | A | | 10/1998 | |
| KR | 20050084274 | A | * | 8/2005 | |
| WO | 2008107788 | A1 | | 9/2008 | |
| WO | 2019203701 | A1 | | 10/2019 | |
| WO | WO-2020246792 | A1 | * | 12/2020 | ..... B60H 1/00278 |

* cited by examiner

COMPONENT HOUSING UNIT AND A VEHICLE THERMAL MANAGEMENT SYSTEM COMPRISING A COMPONENT HOUSING UNIT

RELATED APPLICATION DATA

This application is a continuation of International Patent Application No. PCT/CN2021/100322, filed Jun. 16, 2021, which claims the benefit of European Patent Application No. 20184550.0, filed Jul. 7, 2020, the disclosures of which are incorporated herein by reference in their entireties.

TECHNICAL FIELD

The present disclosure relates to a component housing unit for a vehicle thermal management system. The component housing unit is configured for being attached to an exterior surface of an expansion tank having an interior surface defining an interior volume. The disclosure further relates to a vehicle thermal management system comprising a component housing unit, an expansion tank, a first thermal control loop, and a second thermal control loop.

BACKGROUND

Vehicle thermal management systems are commonly used in today's vehicles for controlling the temperature ranges of different vehicle units, such as for example battery units, power electronics units, heating, ventilation and air conditioning systems, and other types of vehicle units or components being part of the vehicle construction. In for example new energy vehicles, such as for example hybrid or electric vehicles, including battery electric vehicles, fuel-cell electric vehicles and plug-in hybrid electric vehicles, the high voltage battery components used for providing energy to the electric motors as well as the power electronic components need to be temperature controlled. The temperature controlling may depend on for example the driving conditions of the vehicle, the ambient temperature, and the type of components used in the vehicle system. The thermal management of the vehicle is constructed for cooling or heating the respective vehicle systems.

For new energy vehicles, the thermal management systems need a redesign compared to the systems used in traditional vehicles with internal combustion engines. These systems are often complex in design and construction, involving a high number of components that take up space in the vehicle and increase the weight of the vehicle construction. This leads to component packaging problems and weight issues, and further, the thermal management systems are often expensive and non-flexible in construction.

There is thus a need for improved thermal management systems, where the systems are simple in design and construction with fewer components compared to current systems used, where the system further is designed to reduce weight and packaging problems.

SUMMARY

An object of the present disclosure is to provide a component housing unit for a vehicle thermal management system and a vehicle thermal management system where the previously mentioned problems are avoided. This object is at least partly achieved by the features of the independent claims. The dependent claims contain further developments of the component housing unit and the vehicle thermal management system.

The disclosure concerns a component housing unit for a vehicle thermal management system. The component housing unit is configured for being attached to an exterior surface of an expansion tank having an interior surface defining an interior volume. The component housing unit is configured for being connected to a first thermal control loop and a second thermal control loop, and the component housing unit is configured for connecting the interior volume of the expansion tank to the first thermal control loop and the second thermal control loop respectively. The component housing unit comprises a first component interface configured for direct attachment of a first system component connected to the first thermal control loop, and a second component interface configured for direct attachment of a second system component connected to the second thermal control loop.

Advantages with these features are that the thermal management system through the design and configuration of the component housing unit can be made with a compact design having a low weight compared to traditional systems. These systems can further be made with a less complex design and construction with the attachment of the system components to the component interfaces, which are reducing the number of system components taking up space in the vehicle. The component housing unit is thus simplifying the component packaging and is providing a flexible and less expensive construction of the system. The solution is simple in design with fewer components compared to current systems used, providing reduced weight. The component housing is simplifying the integration of different components with each other, and integrating system components in an efficient way is increasingly important for simplifying removal, attachment and replacement of system components when needed.

According to an aspect of the disclosure, the component housing unit comprises a first flow channel connected to the first component interface, and a second flow channel connected to the second component interface. This configuration of the component housing unit is allowing the system components to be integrated into the respective thermal control loops in an efficient way through the connection to the flow channels. The system components can be integrated in the thermal control loops through the attachment to the component interfaces of the component housing unit.

According to another aspect of the disclosure, the first flow channel and the second flow channel are separately arranged from each other within the component housing unit. The separately arranged flow channels are allowing the flows of heat transfer fluid in the respective thermal control loops from being separated from each other if desired.

According to an aspect of the disclosure, the first flow channel comprises a first tank flow port and the second flow channel comprises a second tank flow port. The first tank flow port is configured for connecting the first flow channel to the interior volume of the expansion tank via a first inlet/outlet flow opening of the expansion tank, and the second tank flow port is configured for connecting the second flow channel to the interior volume of the expansion tank via a second inlet/outlet flow opening of the expansion tank. The flow channels are efficiently distributing the heat transfer fluid within the component housing unit, allowing the heat transfer fluid to expand into and flow out from the expansion tank when needed through the configuration of the tank flow ports and the inlet/outlet flow openings.

According to another aspect of the disclosure, the first component interface is configured for attaching a first circulation pump to the component housing unit, and the second component interface is configured for attaching a second circulation pump to the component housing unit. The circulation pumps can be efficiently integrated in the system through the connection to the component interfaces, for a compact and weight saving system design. The circulation pumps are distributing the heat transfer fluid in the respective thermal control loops, and the direct attachment of the circulation pumps to the component housing unit is providing a simple solution.

According to a further aspect of the disclosure, the component housing unit comprises a first housing flow port configured for connecting the component housing unit to the first thermal control loop and/or the second thermal control loop, and a second housing flow port configured for connecting the component housing unit to the second thermal control loop and/or the first thermal control loop. The first flow channel is extending between the first housing flow port and the first component interface, and the second flow channel is extending between the second housing flow port and the second component interface. The flow channels are efficiently distributing the heat transfer fluid within the component housing unit, allowing the heat transfer fluid to expand into and flow out from the expansion tank from the flow channels in the component housing unit when needed.

According to an aspect of the disclosure, the component housing unit comprises a valve unit. The integration of the valve unit within the component housing unit is simplifying the construction of the system for reduced weight and reduced packaging volume. The valve unit is securing an efficient distribution of heat transfer fluid to the respective thermal control loops, and the valve unit may be arranged in different positions depending on the system needs for the distribution of heat transfer fluid.

According to an aspect of the disclosure, when the valve unit is in a first position the thermal control loops are arranged in a parallel relationship, and when the valve unit is in a second position the thermal control loops are arranged in series. The valve unit is securing an efficient distribution of heat transfer fluid to the respective thermal control loops with this configuration. The valve unit is arranged in the first position for parallel distribution of heat transfer fluid to the control loops, and when the thermal control loops are arranged in a parallel relationship, the flow of heat transfer fluid in the first thermal control loop is separated from the flow of heat transfer fluid in the second thermal control loop. The valve unit is arranged in the second position for series distribution of heat transfer fluid to the control loops, and when the thermal control loops are arranged in series, the flow of heat transfer fluid in the first thermal control loop is connected to the flow of heat transfer fluid in the second thermal control loop.

According to another aspect of the disclosure, the valve unit comprises a valve housing formed within the component housing unit, and a first valve inlet flow port and a second valve inlet flow port connected to the valve housing. The first valve inlet flow port is configured for connecting the valve unit to the first thermal control loop, and the second inlet flow port is configured for connecting the valve unit to the second thermal control loop. The valve housing is further connected to the first housing flow port and the second housing flow port. The valve unit is configured for connecting the first valve inlet flow port to the first flow channel and/or the second flow channel, and the second valve inlet flow port to the second flow channel and/or the first flow channel. The formation of the valve housing within the component housing unit is providing a compact design of the system, with an efficient distribution of heat transfer fluid to the respective thermal control loops.

According to a further aspect of the disclosure, the first flow channel comprises a first air separator configured for directing separated air to the expansion tank, and/or the second flow channel comprises a second air separator configured for directing separated air to the expansion tank. The integration of the air separators in the component housing unit is securing an efficient and compact design of the system, with reduced number of separate components used.

According to an aspect of the disclosure, the component housing unit comprises one or more further component interfaces configured for direct attachment of one or more corresponding further system components. The further component interfaces are allowing further system components to be added to the system for an efficient system design with reduced weight and volume.

According to another aspect of the disclosure, the component housing unit is configured for being connected to one or more further thermal control loops, where the component housing unit is configured for connecting the interior volume of the expansion tank to the one or more further thermal control loops. The integration of further thermal control loops is providing flexibility in the system configuration with simple integration through the component housing unit.

The disclosure further concerns a vehicle thermal management system comprising a component housing unit as described above. The system further comprises an expansion tank, a first thermal control loop, a second thermal control loop, a first system component, and a second system component. The expansion tank is arranged with an exterior surface, and an interior surface defining an interior volume. The component hosing unit is attached to the exterior surface of the expansion tank, and the first thermal control loop and the second thermal control loop are connected to the component housing unit. The component housing unit is connecting the interior volume of the expansion tank to the first thermal control loop and the second thermal control loop respectively. The component housing unit comprises a first component interface and a second component interface. The first system component is connected to the first thermal control loop, and the second system component is connected to the second thermal control loop, where the first system component is directly attached to the first component interface and the second system component is directly attached to the second component interface.

Advantages with these features are that the thermal management system through the design and configuration of the component housing unit together with the expansion tank can be made with a compact design having a low weight compared to traditional systems. The systems can be made simple in design and construction with the attachment of the system components to the component interfaces, which are reducing the number of system components taking up space in the vehicle. The component housing unit is further simplifying the component packaging and is providing a flexible and less expensive construction of the system. The component housing with the component interfaces is simplifying the integration of different system components with each other, where the components can be removed, attached and replaced in a simple way when needed.

According to an aspect of the disclosure, the component housing unit comprises a first flow channel connected to the first component interface, and a second flow channel connected to the second component interface. The first flow channel comprises a first tank flow port and the second flow channel comprises a second tank flow port, where the first tank flow port is connecting the first flow channel to the interior volume of the expansion tank via a first inlet/outlet flow opening of the expansion tank, and where the second tank flow port is connecting the second flow channel to the interior volume of the expansion tank via a second inlet/outlet flow opening of the expansion tank. The flow channels are efficiently distributing the heat transfer fluid within the component housing unit, allowing the heat transfer fluid to expand into and flow out from the expansion tank when needed.

According to another aspect of the disclosure, the component housing unit further comprises a valve unit. The integration of the valve unit is further simplifying the construction of the system for reduced weight and volume. The valve unit is securing an efficient distribution of heat transfer fluid to the respective thermal control loops.

According to an aspect of the disclosure, the valve unit comprises a valve housing formed within the component housing unit, and a first valve inlet flow port and a second valve inlet flow port are connected to the valve housing. The first valve inlet flow port is connecting the valve unit to the first thermal control loop, and the second inlet flow port is connecting the valve unit to the second thermal control loop. The valve housing is further connected to a first housing flow port and a second housing flow port. The valve unit is connecting the first valve inlet flow port to the first flow channel and/or the second flow channel, and the second valve inlet flow port to the second flow channel and/or the first flow channel.

According to another aspect of the disclosure, when the valve unit is in a first position the thermal control loops are arranged in a parallel relationship, and when the valve unit is in a second position the thermal control loops are arranged in series. The valve unit is arranged in the first position for parallel distribution of heat transfer fluid to the control loops, and when the thermal control loops are arranged in a parallel relationship, the flow of heat transfer fluid in the first thermal control loop is separated from the flow of heat transfer fluid in the second thermal control loop. The valve unit is arranged in the second position for series distribution of heat transfer fluid to the control loops, and when the thermal control loops are arranged in series, the flow of heat transfer fluid in the first thermal control loop is connected to the flow of heat transfer fluid in the second thermal control loop.

According to an aspect of the disclosure, the component housing unit comprises one or more further component interfaces and the system further comprises one or more corresponding further system components. The one or more further system components are directly attached to the one or more further component interfaces. The component interfaces are simplifying the integration of different system components with each other, and the attachment of the system components to the corresponding component interfaces is providing a compact and efficient system configuration with low weight compared to traditional systems.

According to another aspect of the disclosure, the system further comprises one or more further thermal control loops. The component housing unit is connecting the interior volume of the expansion tank to the one or more further thermal control loops. The integration of further thermal control loops is providing flexibility in the system configuration.

According to a further aspect of the disclosure, the system components are removably attached to their corresponding component interfaces. The component interfaces are simplifying the integration of different system components with each other, where the components can be removed, attached and replaced in a simple way when needed.

BRIEF DESCRIPTION OF THE DRAWINGS

The disclosure will be described in detail in the following, with reference to the attached drawings, in which.

DETAILED DESCRIPTION

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 4:
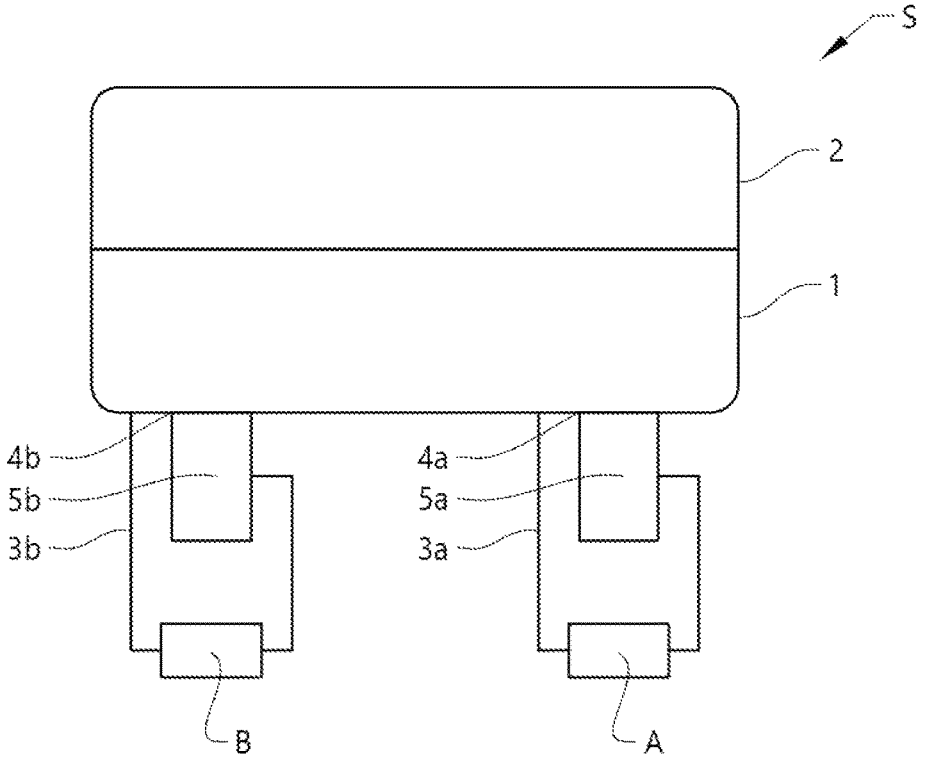
FIG. 4 shows schematically, an embodiment of the vehicle thermal management system with the component housing unit and the expansion tank according to the disclosure.

FIG. 4 schematically shows a schematic structure of a vehicle thermal management system S according to the disclosure, where the system S is used in a vehicle for controlling the temperature ranges of different vehicle units. The system S may also be used for controlling the temperature ranges of a passenger compartment or similar structure of the vehicle. In the embodiment shown in FIG. 4, the vehicle thermal management system has a two thermal control loop configuration, with a first thermal control loop 3*a* and a second thermal control loop 3*b*. The first thermal control loop 3*a* and the second thermal control loop 3*b* are connected to a component housing unit 1, and the component housing unit 1 is connected to an expansion tank 2.

The vehicle thermal management system S is used for controlling the temperature ranges of vehicle units with a heat transfer fluid or coolant that is circulated in the first thermal control loop 3*a* and the second thermal control loop 3*b*, and the temperature ranges of the respective thermal control loops are for example depending on the driving conditions of the vehicle and the variations in ambient temperature. The heat transfer fluid may be of any suitable type for vehicle applications.

In the embodiment illustrated in FIG. 4, the first thermal control loop 3*a* is connected to a first vehicle unit A, and the second thermal control loop 3*b* is connected to a second vehicle unit B. The first vehicle unit A may for example be a battery temperature regulating unit and the second vehicle unit B may for example be a power electronics temperature regulating unit. The battery temperature regulating unit may for example be used for controlling the temperatures of one or more batteries with related components used in the vehicle system. The power electronics temperature regulating unit may for example be used for controlling the temperatures of the power electronic components, such as the electric motor and other electric components being part of the power electronics system.

The thermal control loop configurations and components may be of any conventional type used for vehicle purposes, and will not be described in detail. It should however be understood that the system S may be used for heating or cooling other types of vehicle units or components than the ones described above, depending on the design and construction of the vehicle and the vehicle systems. It should be understood that the respective control loops may include any suitable number of components for controlling the temperature ranges and the flow of heat transfer fluid, such as for example heat exchangers, chillers, heaters, filters, air separators, connectors, fans, valves, circulation pumps, and/or any other components known in the art as related to such thermal systems.

The system may further comprise a control unit for controlling the system components, the temperature ranges, and the flow of heat transfer fluid. The thermal control loops are connecting the component housing unit 1 to the vehicle units or components with conduits, pipes or other suitable connection means. The vehicle thermal management system S according to the disclosure is designed and constructed in a way so that the system is adapted for being operated in different operational modes controlled by the control unit, where the heat transfer fluid is efficiently circulated to the vehicle units or components.

Figure 1A:
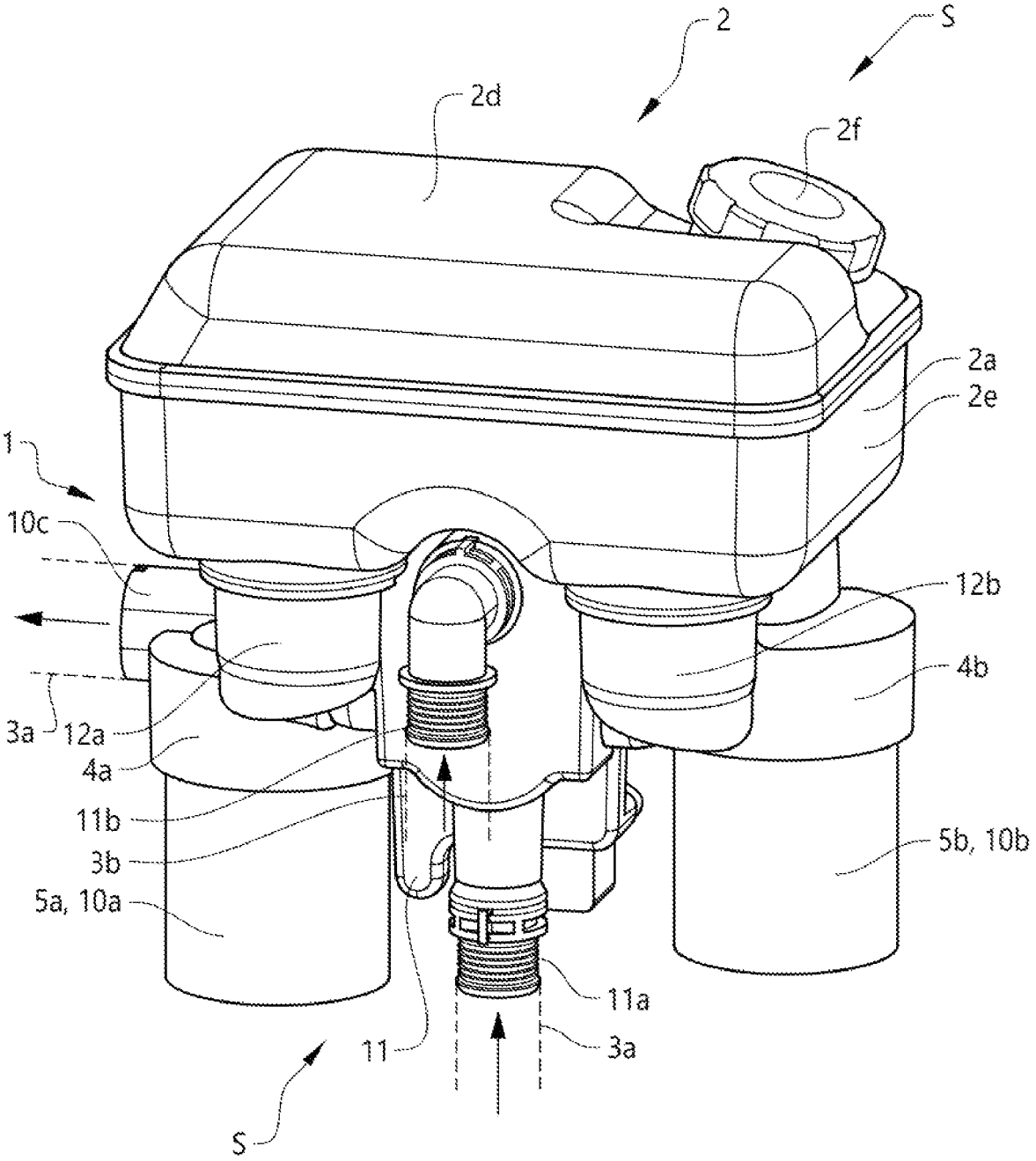
FIGS. 1A-1B show schematically, in front and rear perspective views a component housing unit and an expansion tank according to the disclosure.
Figure 1B:
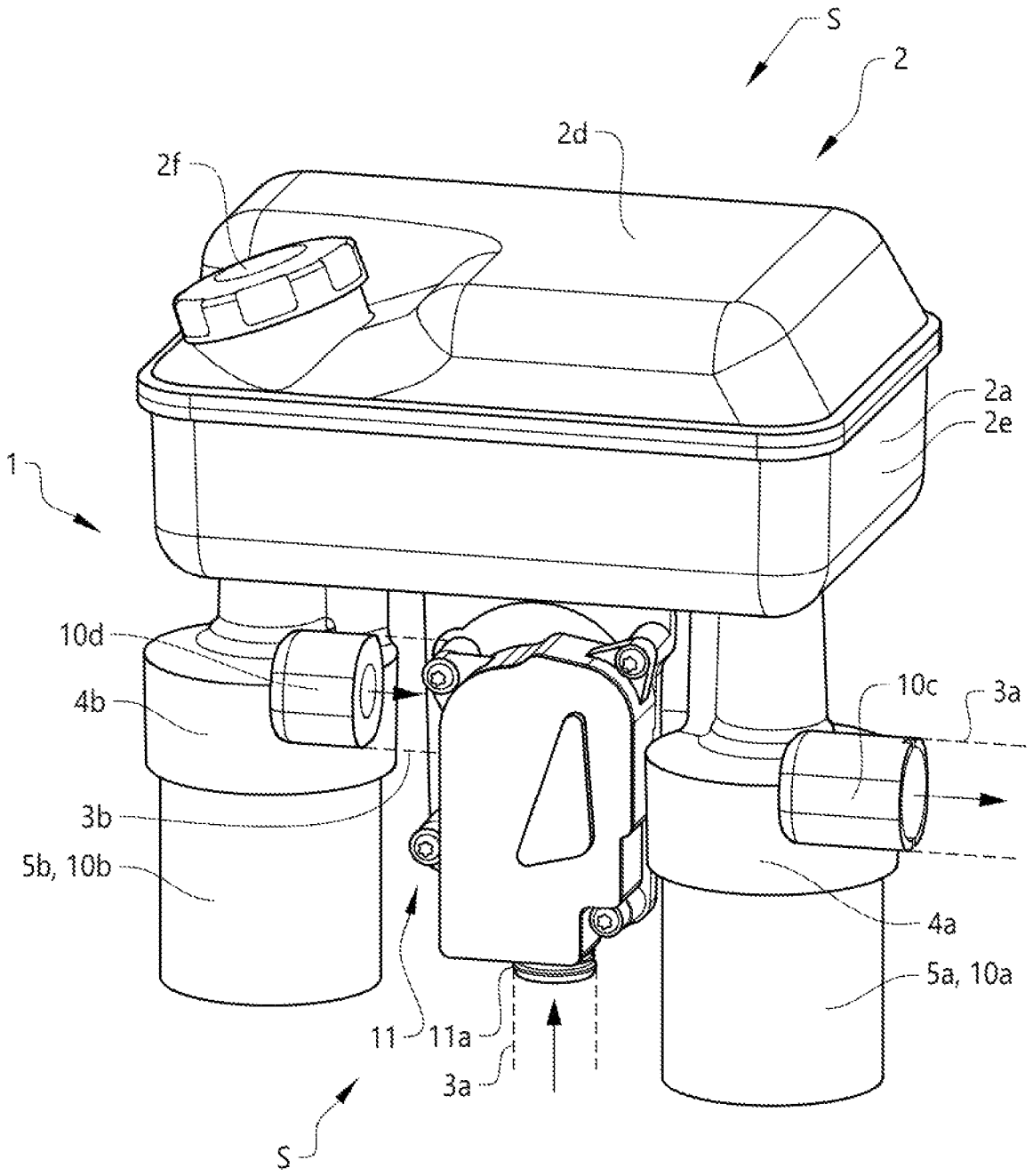
Figure 2:
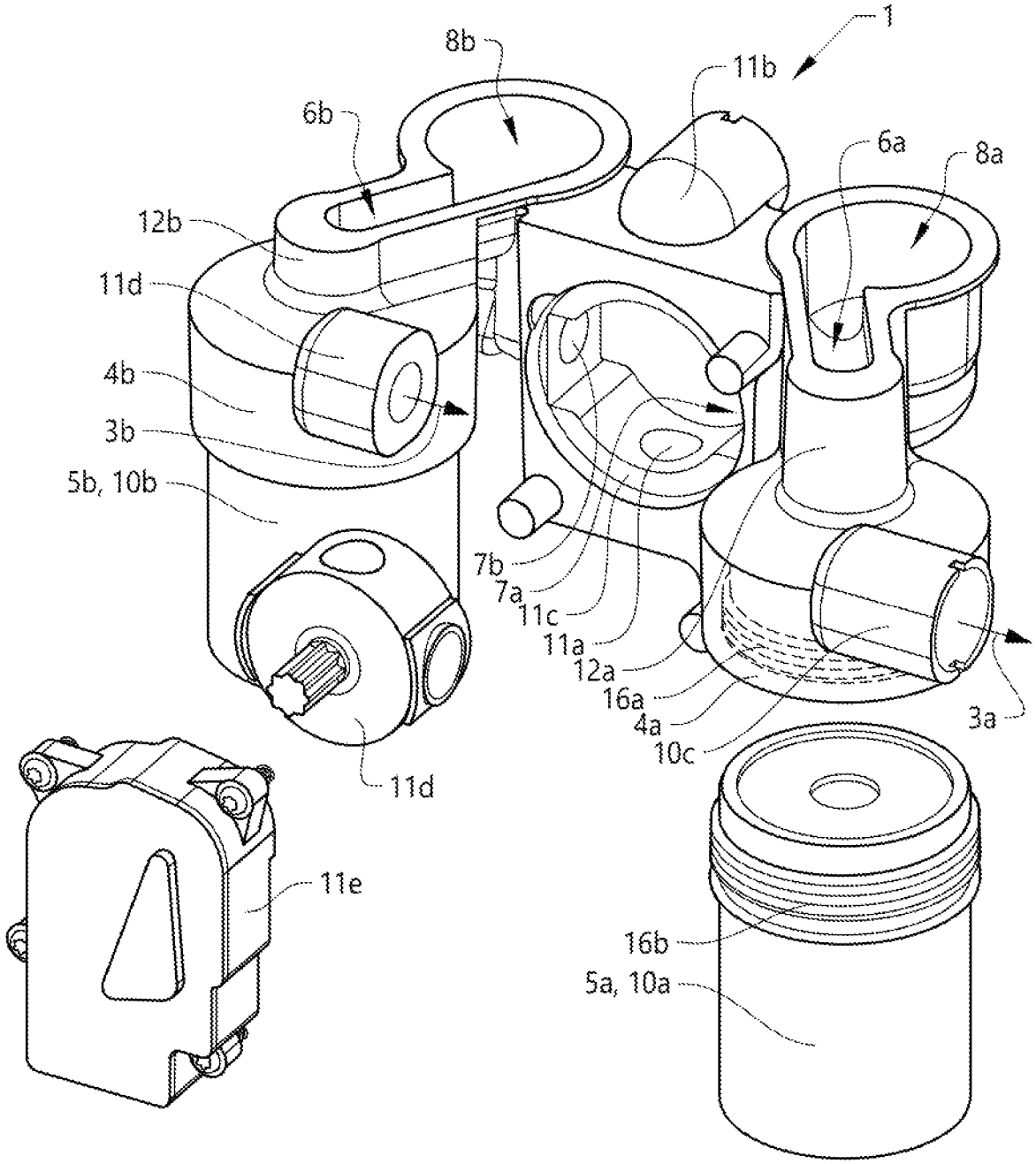
FIG. 2 shows schematically, in a rear perspective view the component housing unit according to the disclosure.

FIG. 2 schematically shows the component housing unit 1 for the vehicle thermal management system S. As schematically shown in FIGS. 1A-1B and 3A-3B, the component housing unit 1 is configured for being attached to an exterior surface 2*a* of the expansion tank 2. The expansion tank 2 has an interior surface 2*b* defining an interior volume 2*c*. The component housing unit 1 is configured for being connected to the first thermal control loop 3*a* and the second thermal control loop 3*b*, as illustrated in FIG. 4 with suitable connection means as will be further described below, and the component housing unit 1 is configured for connecting the interior volume 2*c* of the expansion tank 2 to the first thermal control loop 3*a* and the second thermal control loop 3*b* respectively. Expansion tanks are commonly used in vehicle thermal management systems for handling fluid expansion. The expansion tank 2 may have any suitable configuration for cooperating with the respective thermal control loops, and the heat transfer fluid circulated in the system is allowed to expand into and flow out from the expansion tank 2.

In the embodiment illustrated in FIGS. 1A-1B and 3A-3B, the expansion tank 2 is made from a first tank section 2*d* and a second tank section 2*e* that are joined with suitable attachment means. The first tank section 2*d* is arranged with a fill opening 2*f* for the heat transfer fluid. The fill opening 2*f* may be provided with a lid or other suitable closure means, as schematically indicated in FIGS. 1A-1B. The expansion tank 2 may have other suitable configurations, and the expansion tank 2 may instead be made from a single piece of material, or made from two or more joined sections. The expansion tank 2 may be made from any suitable materials, such as for example plastic materials, composite materials, or metallic materials. The sections forming the expansion tank 2 may for example be glued, welded, screwed together, or alternatively joined by other suitable fastening means. In the illustrated embodiment, the interior volume 2*c* is forming a single compartment for the heat transfer fluid. It should however be understood that the interior volume 2*c* may be divided into two or more compartments depending on the construction and design of the system S. The compartments may be separated from each other for supporting different thermal control loops, and/or alternatively be connected to each other.

As shown in FIGS. 1A-1B, 2 and 3A-3B, the component housing unit 1 comprises a first component interface 4*a* configured for direct attachment of a first system component 5*a*. The first system component 5*a* is connected to the first thermal control loop 3*a*. The first system component 5*a* may be any type of component used in the system S, such as for example a circulation pump, a valve, a heat exchanger, or an air separator. The component housing unit 1 comprises a second component interface 4*b* configured for direct attachment of a second system component 5*b*. The second system component 5*b* is connected to the second thermal control loop 3*b*. The second system component 5*b* may be any type of component used in the system S, such as for example a circulation pump, a valve, a heat exchanger, or an air separator. The first component interface 4*a* and the second component interface 4*b* are provided with suitable connection means for direct attachment of the respective first system component 5*a* and the second system component 5*b*. The connection means of the component interfaces are designed to cooperate with corresponding matching connection means arranged on the system components and any suitable type of connection means may be used, such as for example screw or threaded connectors, bayonet connectors, and plug-in connectors with locking means for holding the system component connected to the corresponding component interface. Through the connection means, the system components 5*a*, 5*b* are removably attached to their corresponding component interfaces 4*a*, 4*b*, for simple maintenance or exchange of components.

In the embodiment illustrated in FIG. 2, the first component interface 4*a* is provided with a set of first threads 16*a*, and the first system component 5*a* is provided with a corresponding cooperating set of second threads 16*b*. The first system component 5*a* is threaded into the first component interface 4*a* for an efficient attachment and removal of the first system component 5*a* to the component housing unit 1. The second component interface 4*b* and the second system component 5*b* may be provided with similar cooperating threads for an efficient attachment and removal of the second system component 5*b* to the component housing unit 1. In FIG. 2, the second system component 5*b* is directly attached to the component housing unit 1 via the second component interface 4*b*. With direct attachment is meant that the system components are directly attached to the component interfaces of the component housing unit 1 without any intermediate hoses or other types of intermediate members. With such a direct attachment, the system can be designed with fewer components for saving space and weight. It should however be understood that gaskets or similar sealing members may be arranged in connection to the component housing unit 1 between the system components and the corresponding component interfaces.

In the embodiments illustrated in the figures, the first system component 5*a* is a first circulation pump 10*a* and the second system component 5*b* is a second circulation pump 10*b*. The first circulation pump 10*a* is pumping heat transfer fluid from the component housing unit 1 to the first thermal control loop 3*a*, and the second circulation pump 10*b* is pumping heat transfer fluid from the component housing unit 1 to the second thermal control loop 3*b*. The first component interface 4*a* is configured for attaching the first circulation pump 10*a* to the component housing unit 1, and the second component interface 4*b* is configured for attaching the second circulation pump 10*b* to the component housing unit 1, for example via cooperating threads as described above. The first circulation pump 10*a* and the second circulation pump 10*b* may be of any conventional type suitable for circulating heat transfer fluid in vehicle thermal systems, and may be of different types and configurations depending on the size and design of the system. As shown in FIGS. 1A-1B and 2, the first component interface 4*a* may be provided with a first pump outlet 10*c* for the flow of heat transfer fluid from the first circulation pump 10*a* into the first thermal control loop 3*a*. The second component interface 4*b* may be provided with a second pump outlet 10*d* for the flow of heat transfer fluid from the second circulation pump 10*b* into the second thermal control loop 3*b*. In an alternative non-illustrated embodiment, the pump outlets may instead be arranged directly on the respective circulation pumps.

Figure 3A:
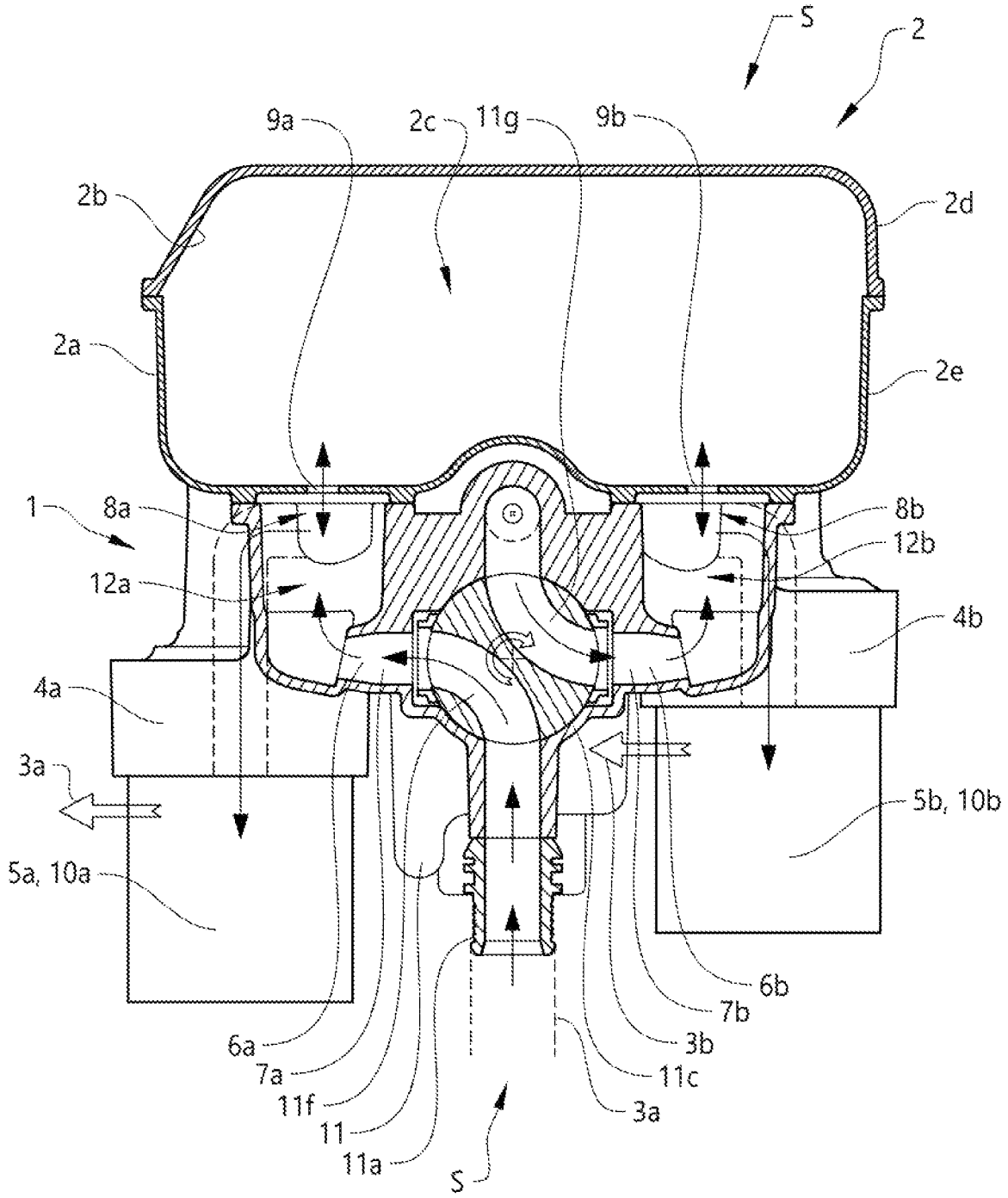
FIGS. 3A-3B show schematically, in front cross-sectional views the component housing unit and the expansion tank according to the disclosure.
Figure 3B:
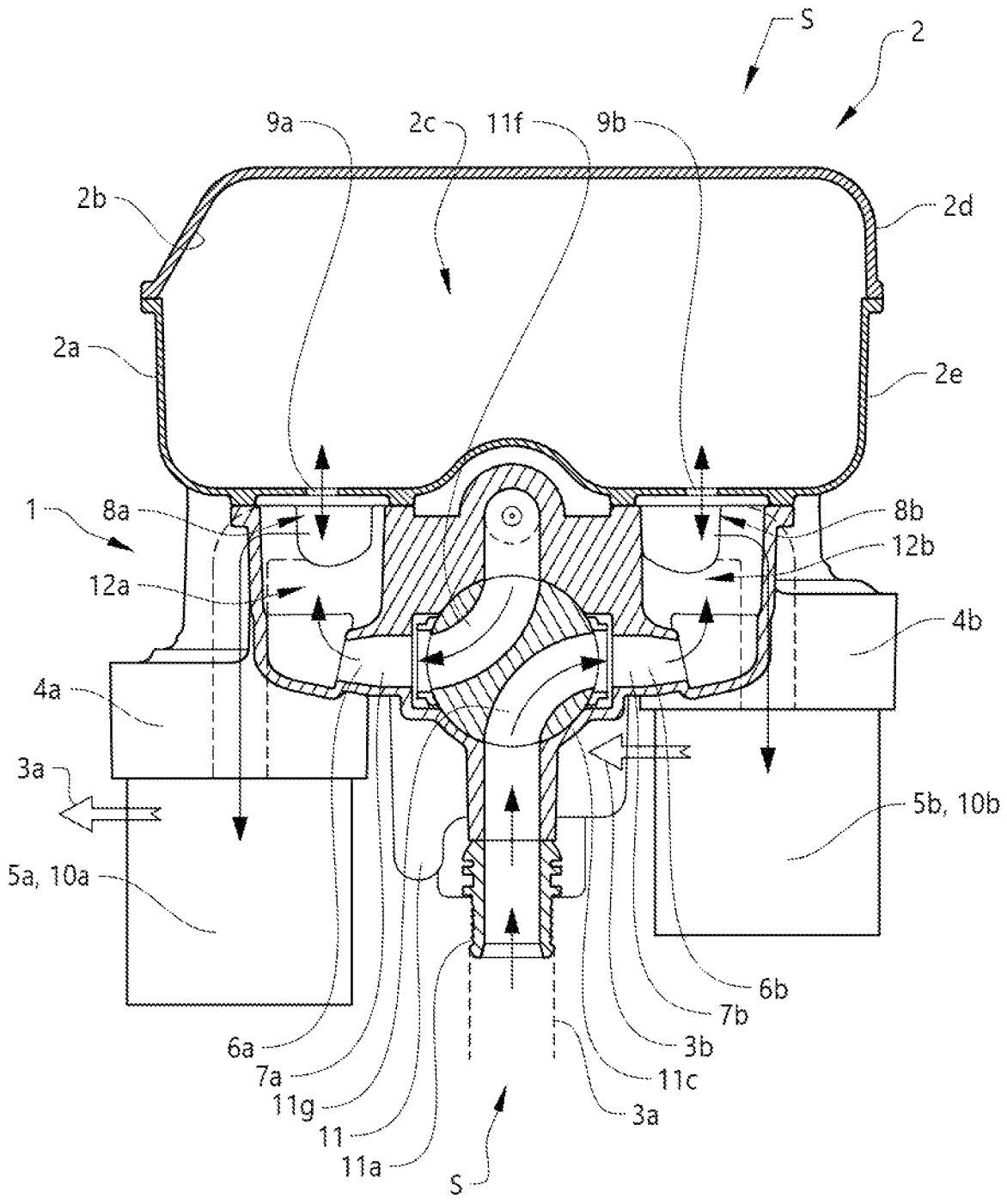

As schematically illustrated in FIGS. 3A-3B, the component housing unit 1 comprises a first flow channel 6*a* and a second flow channel 6*b* for the heat transfer fluid. The first flow channel 6*a* is connected to the first component interface 4*a*, and the second flow channel 6*b* is connected to the second component interface 4*b*, allowing the heat transfer fluid to flow from the respective flow channels 6*a*,6*b* to the circulation pumps 10*a*, 10*b* via the component interfaces 4*a*, 4*b*. In the illustrated embodiment, the first flow channel 6*b* and the second flow channel 6*b* are separately arranged from each other within the component housing unit 1. However, in other embodiments, the first flow channel 6*b* and the second flow channel 6*b* may be directly or indirectly connected to each other within the component housing unit 1.

As schematically illustrated in FIGS. 3A-3B, the first flow channel 6*a* comprises a first tank flow port 8*a* and the second flow channel 6*b* comprises a second tank flow port 8*b*. The expansion tank 2 comprises a first inlet/outlet flow opening 9*a* and a second inlet/outlet flow opening 9*b*. The first tank flow port 8*a* is configured for connecting the first flow channel 6*a* to the interior volume 2*c* of the expansion tank 2 via the first inlet/outlet flow opening 9*a* of the expansion tank 2. The first flow channel 6*a* is thus in fluid communication with the interior volume 2*c* of the expansion tank 2 via the first tank flow port 8*a* and the first inlet/outlet flow opening 9*a*. The first tank flow port 8*a* may for example be arranged as a channel section of or an opening in the first flow channel 6*a*. The first inlet/outlet flow opening 9*a* may be arranged as a channel section of, an opening in, or similar arrangement in the expansion tank 2 allowing fluid communication with the first tank flow port 8*a*. The first tank flow port 8*a* is arranged in an overlapping relationship with the first inlet/outlet flow opening 9*a*, as shown in FIGS. 3A-3B, and the heat transfer fluid can expand from the first flow channel 6*a* into the expansion tank 2 or flow out from the expansion tank 2 to the first flow channel 6*a*. The second tank flow port 8*b* is configured for connecting the second flow channel 6*b* to the interior volume 2*c* of the expansion tank 2 via the second inlet/outlet flow opening 9*b* of the expansion tank 2. The second flow channel 6*b* is thus in fluid communication with the interior volume 2*c* of the expansion tank 2 via the second tank flow port 8*b* and the second inlet/outlet flow opening 9*b*. The second tank flow port 8*b* may for example be arranged as a channel section of or an opening in the first flow channel 6*a*. The second inlet/outlet flow opening 9*b* may be arranged as a channel section of, an opening in, or similar arrangement in the expansion tank 2 allowing fluid communication with the second tank flow port 8*b*. The second tank flow port 8*b* is arranged in an overlapping relationship with the second inlet/outlet flow opening 9*b*, as shown in FIGS. 3A-3B, and the heat transfer fluid can expand from the second flow channel 6*b* into the expansion tank 2 or flow out from the expansion tank 2 to the second flow channel 6*b*.

With the described configuration of the system S, the component housing unit 1 comprises the first flow channel 6*a* connected to the first component interface 4*a*, and the second flow channel 6*b* connected to the second component interface 4*b*. The first flow channel 6*a* comprises the first tank flow port 8*a* and the second flow channel 6*b* comprises the second tank flow port 8*b*. The first tank flow port 8*a* is efficiently connecting the first flow channel 6*a* to the interior volume 2*c* of the expansion tank 2 via the first inlet/outlet flow opening 9*a* of the expansion tank 2, and the second tank flow port 8*b* is efficiently connecting the second flow channel 6*b* to the interior volume 2*c* of the expansion tank 2 via the second inlet/outlet flow opening 9*b* of the expansion tank 2.

As schematically illustrated in FIGS. 3A-3B, the component housing unit 1 comprises a first housing flow port 7*a* configured for connecting the component housing unit 1 to the first thermal control loop 3*a* and/or the second thermal control loop 3*b*. The component housing unit 1 comprises a second housing flow port 7*b* configured for connecting the component housing unit 1 to the second thermal control loop 3*b* and/or the first thermal control loop 3*a*. The first flow channel 6*a* is extending between the first housing flow port 7*a* and the first component interface 4*a*, and the second flow channel 6*a* is extending between the second housing flow port 7*b* and the second component interface 4*b*.

The component housing unit 1 may further comprise one or more valve units. The valve unit 11 may have any suitable configuration for distributing the flow of heat transfer fluid entering the component housing unit 1 from the first thermal control loop 3*a* to the first flow channel 6*a* and/or the second flow channel 6*b*, and for distributing the flow of heat transfer fluid entering the component housing unit 1 from the second thermal control loop 3*b* to the second flow channel 6*b* and/or the first flow channel 6*a*.

In the embodiment illustrated in FIGS. 1A-1B, 2 and 3A-3B, the component housing unit 1 further comprises one valve unit 11. The valve unit 11 comprises a valve housing 11*c* formed within the component housing unit 1, a first valve inlet flow port 11*a* and a second valve inlet flow port 11*b* connected to the valve housing 11*c*. The first valve inlet flow port 11*a* is configured for connecting the valve unit 11 to the first thermal control loop 3*a*, and the second inlet flow port 11*b* is configured for connecting the valve unit 11 to the second thermal control loop 3*b*. The valve housing 11*c* is further connected to the first housing flow port 7*a* and the second housing flow port 7*b* respectively. The valve unit 11 is through this design configured for connecting the first valve inlet flow port 11*a* to the first flow channel 6*a* and/or the second flow channel 6*b*, and the second valve inlet flow port 11*b* to the second flow channel 6*b* and/or the first flow channel 6*a*. The valve unit 11 further comprises a valve member 11*d* that is movable between different valve positions, as schematically illustrated in FIGS. 3A-3B. The movable valve member 11*d* is connected to a valve actuator 11*e*, as shown in FIG. 2, and the valve actuator 11*e* is arranged for moving the valve member 11*d* between the different valve positions. The valve actuator 11*e* may have any suitable configuration and design, and as an example, an electric motor may be used as the valve actuator 11*e*. The valve member 11*d* comprises a first valve flow channel 11*f* and a second valve flow channel 11*g* for the heat transfer fluid, and with the first and second valve flow channels, the valve unit 11 has a four-way valve configuration. In this way, the system S comprises the valve unit 11, for an efficient distribution of the heat transfer fluid through the connection of the first valve inlet flow port 11*a* to the first flow channel 6*a* and/or the second flow channel 6*b*, and the second valve inlet flow port 11*b* to the second flow channel 6*b* and/or the first flow channel 6*a*, as will be further described below.

In FIG. 3A, the valve unit 11 is arranged in a first valve position. In the first valve position, the valve unit 11 is distributing the heat transfer fluid in the first valve flow channel 11*f* from the first valve inlet flow port 11*a* to the first flow channel 6*a*, and in the second valve flow channel 11*g* from the second valve inlet flow port 11*b* to the second flow channel 6*b*. In this way the thermal control loops are arranged in a parallel relationship, where the flow of heat transfer fluid in the first thermal control loop 3*a* is separated from the flow of heat transfer fluid in the second thermal control loop 3*b*.

In FIG. 3B, the valve unit 11 is arranged in a second valve position. In the second valve position, the valve unit 11 is distributing the heat transfer fluid in the second valve flow channel 11*g* from the first valve inlet flow port 11*a* to the second flow channel 6*b*, and in the first valve flow channel 11*f* from the second valve inlet flow port 11*b* to the first flow channel 6*a*. In this way the thermal control loops are arranged in series, where the flow of heat transfer fluid in the first thermal control loop 3*a* is connected to the flow of heat transfer fluid in the second thermal control loop 3*b*.

The vehicle thermal management system S could with the described configuration be arranged with few components, where the system S comprises the component housing unit 1, the expansion tank 2, the first thermal control loop 3*a*, the second thermal control loop 3*b*, the first system component 5*a*, and the second system component 5*b*. The expansion tank 2 is as described above arranged with the exterior surface 2*a*, and the interior surface 2*b* defining the interior volume 2*c*. The component hosing unit 1 is attached to the exterior surface 2*a* of the expansion tank 2 with suitable attachment means. The component housing unit 1 and the expansion tank 2 may be made from any suitable materials, such as for example plastic materials, composite materials, or metallic materials. The component housing unit 1 may be attached to the expansion tank 2 through for example gluing or welding, or alternative by using screws, rivets or other suitable alternative fastening means. The first thermal control loop 3*a* and the second thermal control loop 3*b* are connected to the component housing unit 1, and the thermal control loops are connecting the component housing unit 1 to the respective vehicle units with conduits, pipes or other suitable connection means. The valve inlet flow ports and the pump outlets of the component housing unit 1 may be arranged with suitable connectors for the conduits or pipes of the system. The component housing unit 1 is connecting the interior volume 2*c* of the expansion tank 2 to the first thermal control loop 3*a* and the second thermal control loop 3*b* respectively, and the heat transfer fluid in the thermal control loops is allowed to expand into and flow out from the expansion tank 2. The component housing unit 1 comprises the first component interface 4*a* and the second component interface 4*b*. The first system component 5*a* is directly attached to the first component interface 4*a* and the first system component 5*a* is through the attachment to the first component interface 4*a* connected to the first thermal control loop 3*a*. The second system component 5*b* is directly attached to the second component interface 4*b* and the second system component 5*b* is through the attachment to the second component interface 4*b* connected to the second thermal control loop 3*b*.

In a non-illustrated embodiment, the valve unit 11 may be arranged with a third valve flow channel for the heat transfer fluid in addition to the first valve flow channel 11*f* and the second valve flow channel 11*g*. If the third valve flow channel has an X-like configuration inter-connecting all of the first valve inlet flow port 11, the second valve inlet flow port 11*b*, the first housing flow port 7*a*, and the second housing flow port 7*b*, the valve unit 11 is arranged in a five-way valve configuration. The third valve flow channel may be used for mixing the heat transfer fluid entering the component housing unit 1 from the first thermal control loop 3*a* via the first valve inlet flow port 11*a* and the second thermal control loop 3*b* via the second valve inlet flow port 11*b*, for further distribution of the mixed heat transfer fluid into the respective first flow channel 6*a* and the second flow channel 6*b*.

In alternative non-illustrated embodiments, the component housing unit 1 may be arranged without the valve unit if suitable, depending on the design and configuration of the system S. In further alternative non-illustrated embodiments, the component housing unit may be arranged with two or more valve units integrated within the housing structure in the same way as described in the embodiment above. One or more valve units may also be arranged in connection to the thermal control loops instead of being integrated within the component housing unit 1.

The first flow channel 6*a* may comprise a first air separator 12*a* configured for directing separated air to the expansion tank 2, and/or the second flow channel 6*b* comprises a second air separator 12*b* configured for directing separated air to the expansion tank 2. The respective air separators may be connected to the interior volume 2*c* of the expansion tank 2 via the tank flow ports of the component housing unit 1, and the inlet/outlet flow openings of the expansion tank 2.

In the embodiment illustrated in FIGS. 1A-1B, 2, and 3A-3B, the first flow channel 6*a* comprises a first air separator 12*a* arranged in connection to the first tank flow port 8*a* of the component housing unit 1. The second flow channel 6*b* comprises a second air separator 12*b* arranged in connection to the second tank flow port 8*b* of the component housing unit 1. The air separators may have any configuration and design.

Some vehicle thermal control systems are constructed with more than two thermal control loops, where each thermal control loop is used for heating and or cooling a specific vehicle unit or vehicle component.

Figure 5:
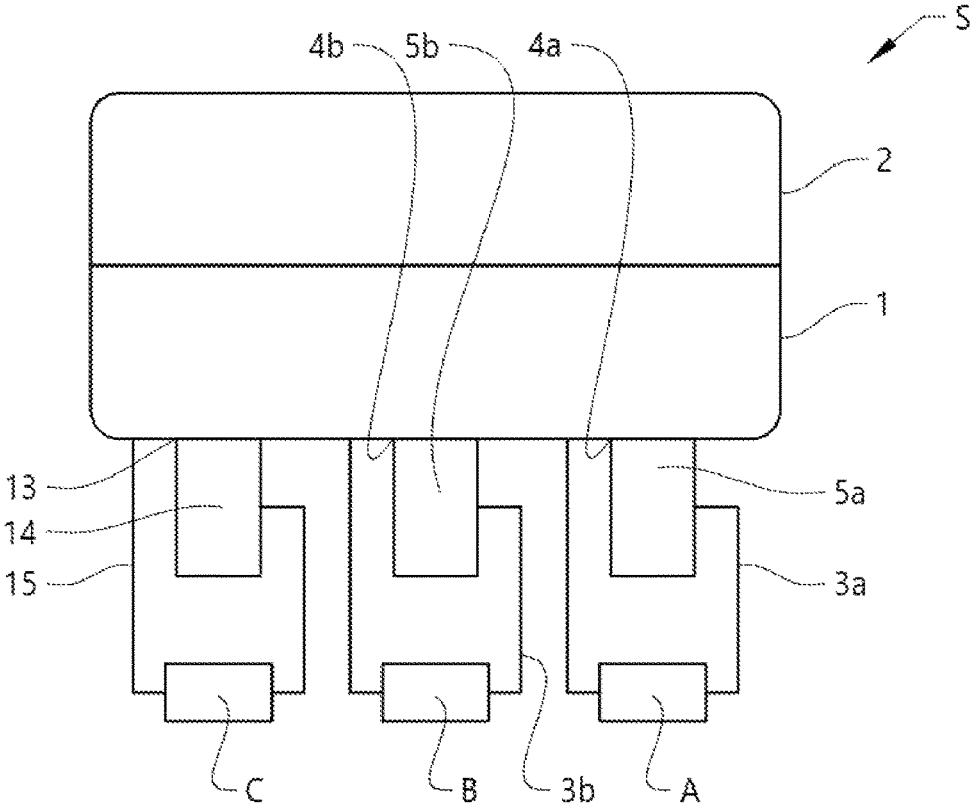
FIG. 5 shows schematically, an alternative embodiment of the vehicle thermal management system with the component housing unit and the expansion tank according to the disclosure.

In FIG. 5, an example vehicle thermal management system S is schematically illustrated, where the vehicle thermal management system has a three thermal control loop configuration. In this embodiment, the system S comprises a first thermal control loop 3*a*, a second thermal control loop 3*b*, and a further thermal control loop 15. The first thermal control loop 3*a*, the second thermal control loop 3*b*, and the further thermal control loop 15 are connected to a component housing unit 1, and the component housing unit 1 is connected to an expansion tank 2, in a similar way as described in the embodiment above. The first thermal control loop 3*a* and the second thermal control loop 3*b* may have the same configuration as described in the embodiment above. In this embodiment, the component housing unit 1 may comprise one or more valve units for distributing the heat transfer fluid in the respective thermal control loops.

The component housing unit 1 may comprise one or more further component interfaces 13 configured for direct attachment of one or more corresponding further system components 14. The one or more further component interfaces 13 may have the same configurations as the first component interface 4*a* and the second component interface 4*b* described above. The one or more further system components 14, may be any type or types of components used in the system S, such as for example circulation pumps, valves, heat exchangers, or air separators. In this way, the component housing unit 1 is configured for being connected to one or more further thermal control loops 15, and the component housing unit 1 is configured for connecting the interior volume 2*c* of the expansion tank 2*a* to the one or more further thermal control loops 15. With such a system configuration, the component housing unit 1 comprises one or more further component interfaces 13 and the system S further comprises one or more corresponding further system components 14, where the one or more further system components 14 are directly attached to the one or more further component interfaces 13. With direct attachment is meant that the system components are directly attached to the component interfaces of the component housing unit 1 without any intermediate hoses or other types of intermediate members. With such a direct attachment, the system can be designed with fewer components for saving space and weight. It should however be understood that gaskets or similar sealing members may be arranged in connection to the component housing unit 1 between the system components and the corresponding component interfaces.

In the embodiment illustrated in FIG. 5, the system S further comprises one further thermal control loop 15 in addition to the first thermal control loop 3*a* and the second thermal control loop 3*b*, and one further system component 14 is connected to the further thermal control loop 15. The component housing unit 1 is thus connecting the interior volume 2*c* of the expansion tank 2 to the further thermal control loop 15. The further system component 14 may be any type of component used in the system S, such as for example a circulation pump, a valve, a heat exchanger, or an air separator. The further component interface 13 is provided with suitable connection means for direct attachment of the further system component 14. The connection means of the further component interface 13 is as described above designed to cooperate with corresponding matching connection means arranged on the further system component and any suitable type of connection means may be used, such as for example screw or threaded connectors, bayonet connectors, and plug-in connectors with locking means for holding the system component connected to the corresponding component interface. Through the connection means, the system components 5*a*, 5*b*, 14 are removably attached to their corresponding component interfaces 4*a*, 4*b*, 13, for simple maintenance or exchange of components. Each component interface may for example be provided with a set of first threads, and each of the system components may be provided with a corresponding cooperating set of second threads. The system components may with this configuration be threaded into their corresponding component interfaces for efficient attachment and removal of the system components to the component housing unit 1.

In the embodiment illustrated in FIG. 5, the first thermal control loop 3*a* is connected to a first vehicle unit A, the second thermal control loop 3*b* is connected to a second vehicle unit B, and the further thermal control loop 15 is connected to a third vehicle unit C. The first vehicle unit A may for example be a battery temperature regulating unit, the second vehicle unit B may for example be a power electronics temperature regulating unit, and the third vehicle unit C for example be an internal combustion engine in a hybrid vehicle powertrain. The battery temperature regulating unit may for example be used for controlling the temperatures of one or more batteries with related components used in the vehicle system. The power electronics temperature regulating unit may for example be used for controlling the temperatures of the power electronic components, such as the electric motor and other electric components being part of the power electronic system. The further thermal control loop 15 is used for controlling the temperature of the internal combustion engine constituting the third vehicle unit C.

The thermal control loop configurations and components may be of any conventional type used for vehicle purposes, and will not be described in detail. It should however be understood that the system S may be used for heating or cooling other types of vehicle units or components than the ones described above, depending on the design and construction of the vehicle and the vehicle systems. It should be understood that the respective control loops may include any suitable number of components for controlling the temperature ranges and the flow of heat transfer fluid, such as for example heat exchangers, chillers, heaters, filters, air separators, connectors, fans, valves, circulation pumps, and/or any other components known in the art as related to such thermal systems.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

REFERENCE SIGNS

1: Component housing unit
2: Expansion tank
2*a*: Exterior surface
2*b*: Interior surface
2*c*: Interior volume
2*d*: First tank section
2*e*: Second tank section
2*f*: Fill opening
3*a*: First thermal control loop
3*b*: Second thermal control loop
4*a*: First component interface
4*b*: Second component interface
5*a*: First system component
5*b*: Second system component
6*a*: First flow channel

6*b*: Second flow channel
7*a*: First housing flow port
7*b*: Second housing flow port
8*a*: First tank flow port
8*b*: Second tank flow port
9*a*: First inlet/outlet flow opening
9*b*: Second inlet/outlet flow opening
10*a*: First circulation pump
10*b*: Second circulation pump
10*c*: First pump outlet
10*d*: Second pump outlet
11: Valve unit
11*a*: First valve inlet flow port
11*b*: Second valve inlet flow port
11*c*: Valve housing
11*d*: Valve member
11*e*: Valve actuator
11*f*: First valve flow channel
11*g*: Second valve flow channel
12*a*: First air separator
12*b*: Second air separator
13: Further component interfaces
14: Further system components
15: Further thermal control loops
16*a*: First threads
16*b*: Second threads
A: First vehicle unit
B: Second vehicle unit
C: Third vehicle unit
S: Vehicle thermal management system

What is claimed is:

1. A component housing unit for a vehicle thermal management system that includes an expansion tank having an exterior surface and an interior surface defining an interior volume, a first thermal control loop, a first system component fluidically interfaced with the first thermal control loop, a second thermal control loop, and a second system component fluidically interfaced with the second thermal control loop, wherein the expansion tank has a first inlet/outlet opening extending through the exterior and interior surfaces and a second inlet/outlet opening extending through the exterior and interior surfaces, the component housing unit comprising:

a first flow channel that includes a first tank flow port, the first flow channel fluidically interfaced to the first thermal control loop by the first system component, and the first tank flow port fluidically connected to the first inlet/outlet opening of the expansion tank, wherein a portion of the first flow channel that includes the first tank flow port is surrounded by a surface of the component housing unit that couples to the exterior surface of the expansion tank to enclose the portion of the first flow channel with a combination of the component housing unit and the exterior surface of the expansion tank;

a second flow channel that includes a second tank flow port, the second flow channel fluidically interfaced to the second thermal control loop by the second system component, and the second tank flow port fluidically connected to the second inlet/outlet opening of the expansion tank, wherein a portion of the second flow channel that includes the second tank flow port is surrounded by a surface of the component housing unit that couples to the exterior surface of the expansion tank to enclose the portion of the second flow channel with a combination of the component housing unit and the exterior surface of the expansion tank;

a first component interface that directly attaches to the first system component and a second component interface that directly attaches to the second system component; and a valve unit that has a first position in which the first and second thermal control loops are arranged in a parallel relationship and a second position in which the first and second thermal control loops are arranged in series.

2. The component housing unit according to claim 1, wherein the first flow channel and the second flow channel are separately arranged from each other within the component housing unit.

3. The component housing unit according to claim 1, wherein the first system component is a first circulation pump and the second system component is a second circulation pump.

4. The component housing unit according to claim 1, wherein the component housing unit comprises a first housing flow port configured for connecting the component housing unit to the first thermal control loop and/or the second thermal control loop, and a second housing flow port configured for connecting the component housing unit to the second thermal control loop and/or the first thermal control loop, wherein the first flow channel extends between the first housing flow port and the first component interface, and wherein the second flow channel is extending between the second housing flow port and the second component interface.

5. The component housing unit according to claim 4, wherein the valve unit comprises a valve housing formed within the component housing unit, and a first valve inlet flow port and a second valve inlet flow port connected to the valve housing; wherein the first valve inlet flow port is configured for connecting the valve unit to the first thermal control loop, and the second inlet flow port is configured for connecting the valve unit to the second thermal control loop; wherein the valve housing further is connected to the first housing flow port and the second housing flow port, wherein the valve unit is configured for connecting the first valve inlet flow port to the first flow channel and/or the second flow channel, and the second valve inlet flow port to the second flow channel and/or the first flow channel.

6. The component housing unit according to claim 1, wherein the first flow channel comprises a first air separator configured for directing separated air to the expansion tank, and/or the second flow channel comprises a second air separator configured for directing separated air to the expansion tank.

7. The component housing unit according to claim 1, wherein the component housing unit comprises one or more further component interfaces configured for direct attachment of one or more corresponding further system components.

8. The component housing unit according to claim 1, wherein the component housing unit is configured for being connected to one or more further thermal control loops, wherein the component housing unit is configured for connecting the interior volume of the expansion tank to the one or more further thermal control loops.

9. A vehicle thermal management system comprising the component housing unit according to claim 1, wherein the system further comprises the expansion tank, the first thermal control loop, the second thermal control loop, the first system component, and the second system component.

10. The vehicle thermal management system according to claim 9, wherein the valve unit comprises a valve housing formed within the component housing unit, and a first valve inlet flow port and a second valve inlet flow port connected to the valve housing; wherein the first valve inlet flow port connects the valve unit to the first thermal control loop, and the second inlet flow port connects the valve unit to the second thermal control loop; wherein the valve housing further is connected to a first housing flow port and a second housing flow port, wherein the valve unit connects the first valve inlet flow port to the first flow channel and/or the second flow channel, and the second valve inlet flow port to the second flow channel and/or the first flow channel.

11. The vehicle thermal management system according to claim 9, wherein the component housing unit comprises one or more further component interfaces and the system further comprises one or more corresponding further system components, wherein the one or more further system components are directly attached to the one or more further component interfaces.

12. The vehicle thermal management system according to claim 9, wherein the system further comprises one or more further thermal control loops, wherein the component housing unit is connecting the interior volume of the expansion tank to the one or more further thermal control loops.

13. The vehicle thermal management system according to claim 9, wherein the system components are removably attached to their corresponding component interfaces.

* * * * *